US008580468B2

(12) United States Patent
Taguchi et al.

(10) Patent No.: US 8,580,468 B2
(45) Date of Patent: Nov. 12, 2013

(54) DEVELOPER FOR ELECTROSTATIC PHOTOGRAPHY, PROCESS CARTRIDGE FOR IMAGE FORMING APPARATUS, IMAGE FORMING APPARATUS, AND IMAGE FORMING METHOD

(75) Inventors: Tetsuya Taguchi, Kanagawa (JP); Hirokazu Hamano, Kanagawa (JP); Masahiro Takagi, Kanagawa (JP); Tsuyoshi Murakami, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 106 days.

(21) Appl. No.: 13/227,054

(22) Filed: Sep. 7, 2011

(65) Prior Publication Data

US 2012/0122026 A1 May 17, 2012

(30) Foreign Application Priority Data

Nov. 12, 2010 (JP) ..... 2010-254248

(51) Int. Cl.
*G03G 9/00* (2006.01)

(52) U.S. Cl.
USPC ..... 430/108.1; 430/124.1; 399/122; 399/320

(58) Field of Classification Search
USPC ..... 430/108.1, 124.1; 399/122, 320
See application file for complete search history.

(56) References Cited

U.S. PATENT DOCUMENTS

| | | | | |
|---|---|---|---|---|
| 2005/0163543 | A1* | 7/2005 | Satoh et al. | 399/329 |
| 2008/0014523 | A1 | 1/2008 | Tabata | |
| 2008/0070145 | A1 | 3/2008 | Onda et al. | |
| 2008/0124636 | A1 | 5/2008 | Yamaguchi et al. | |
| 2011/0086306 | A1* | 4/2011 | Bayley et al. | 430/108.2 |

FOREIGN PATENT DOCUMENTS

| | | |
|---|---|---|
| JP | A-2004-212599 | 7/2004 |
| JP | A-2005-274745 | 10/2005 |
| JP | A-2006-154641 | 6/2006 |
| JP | A-2007-79223 | 3/2007 |
| JP | A-2008-40465 | 2/2008 |
| JP | A-2008-70663 | 3/2008 |
| JP | A-2009-85975 | 4/2009 |

* cited by examiner

*Primary Examiner* — Hoa V Le
(74) *Attorney, Agent, or Firm* — Oliff & Berridge, PLC

(57) ABSTRACT

A developer for electrostatic photography, includes: a toner containing toner particles containing a colorant and a binder resin, and an external additive having a number average particle diameter of about 100 nm or more and about 800 nm or less; and rugged particles having a rate of ruggedness represented by formula (1) of about 30% or more and about 70% or less:

$$\text{Rate of Ruggedness} = 100 - (\text{Projected area}/\text{Envelope area}) \times 100 \quad (1).$$

17 Claims, 5 Drawing Sheets

LIBERATED EXTERNAL ADDITIVE
RUGGED PARTICLE
ENVELOPE
CARRIER

DEVELOPER FOR ELECTROSTATIC PHOTOGRAPHY, PROCESS CARTRIDGE FOR IMAGE FORMING APPARATUS, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2010-254248 filed Nov. 12, 2010.

BACKGROUND

1. Technical Field

The present invention relates to a developer for electrostatic photography, a process cartridge for an image forming apparatus, an image forming apparatus, and an image forming method.

2. Related Art

In image formation by electrophotography, an image is obtained by charging; exposing the image to form an electrostatic latent image on a latent image holding member (photoreceptor); developing the electrostatic latent image to form a developed image; transferring the developed image on a recording medium; and fixing the transferred image by heating, and the like. Developers for electrostatic photography used in such electrophotography are generally divided into single-component developers using only a toner, in which a colorant is dispersed in a binder resin, and two-component developers including a toner and a carrier.

For the two-component developer, since the carrier has a relatively large surface area, charging is easily performed with the toner, and since magnetic particles are used for the carrier, transporting is easily performed by Magroll, and the like. For at least these reasons, the two-component developer is widely used at present.

SUMMARY

According to an aspect of the invention, there is provided a developer for electrostatic photography, including:

a toner containing toner particles containing a colorant and a binder resin, and an external additive having a number average particle diameter of about 100 nm or more and about 800 nm or less; and rugged particles having a rate of ruggedness represented by formula (1) of about 30% or more and about 70% or less:

$$\text{Rate of Ruggedness}=100-(\text{Projected area}/\text{Envelope area})\times 100 \quad (1).$$

BRIEF DESCRIPTION OF THE DRAWINGS

Exemplary embodiments of the present invention will be described in detail based on the following figures, wherein.

DETAILED DESCRIPTION

Figures 1A, 1B, 1C, 1D:
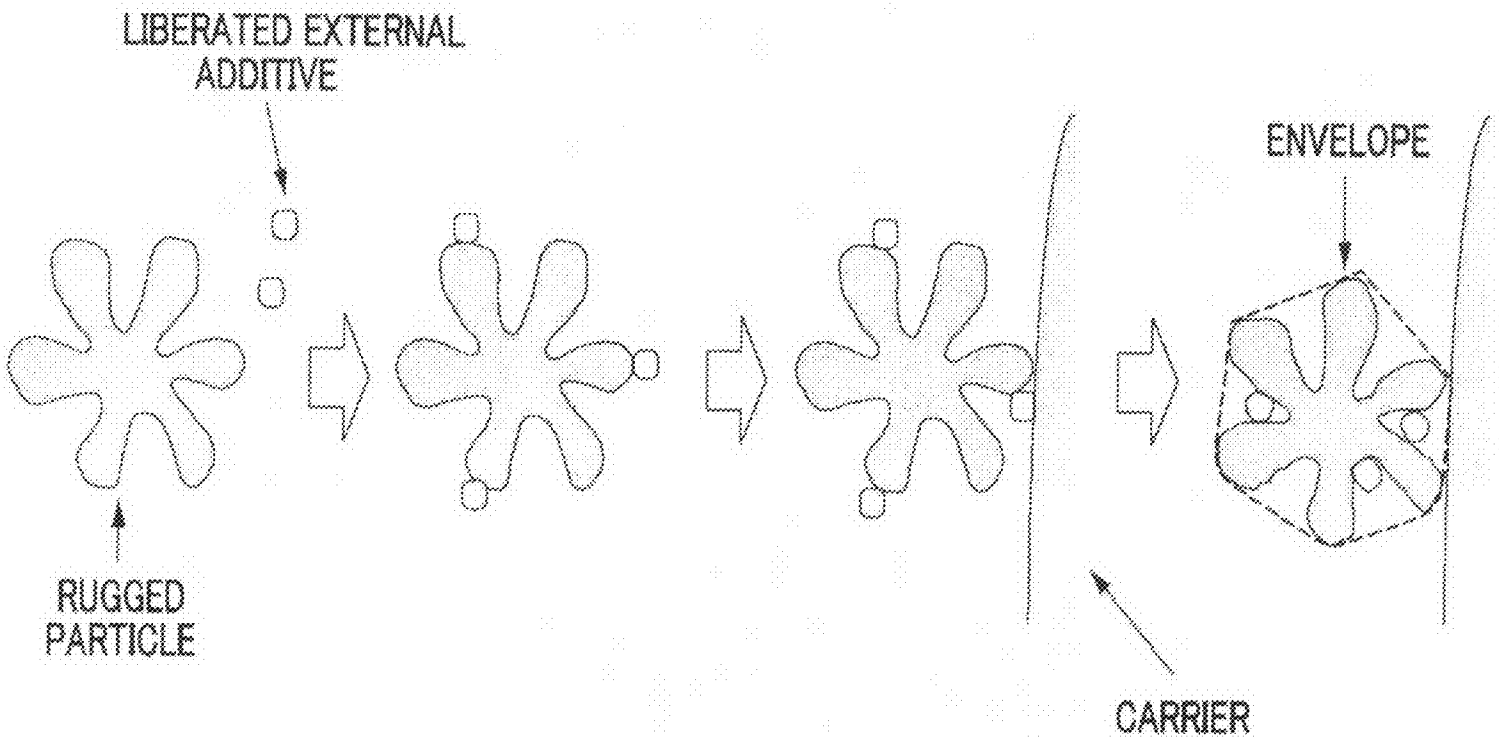
FIGS. 1A to 1D are conceptual views for explaining the action/function of the specific rugged particle.

Hereinafter, exemplary embodiments of the developer for electrostatic photography, the process cartridge, the image forming apparatus, and the image forming method of some aspects of the present invention will be described in detail.

<Developer for Electrostatic Photography>

The developer for electrostatic photography according to the present exemplary embodiment (which may be hereinafter sometimes referred to as the developer of the present exemplary embodiment) includes a toner containing toner particles including at least a colorant and a binder resin, and an external additive, in which the number average particle diameter of the external additives is about 100 nm or more and about 800 nm or less, and rugged particles having a rate of ruggedness represented by formula (1) of about 30% or more and about 70% or less:

$$\text{Rate of Ruggedness}=100-(\text{Projected area}/\text{Envelope area})\times 100 \quad (1).$$

Since the large-diameter external additives are not easily embedded in a toner surface even under external force, they are recently used so as to maintain a transfer property. For example, in the case of a toner having a low melting temperature, external additives are easily embedded, and accordingly, large-diameter external additives are effective. Further, in the present exemplary embodiment, the large-diameter external additives refer to external additives having a number average particle diameter of 100 nm or more.

On the other hand, the large-diameter external additives are more easily liberated from a toner, as compared with the external additives having a number average particle diameter of less than 100 nm. With adherence of the large-diameter external additives, the adherence strength is enhanced to make it difficult to dissociate the external additives from the toner surface, and accordingly, the liberation of the large-diameter external additive from the toner is improved. However, at this time, since the large-diameter external additives are excessively embedded in the surface of the toner particle, the function of the large-diameter external additives as a spacer may be reduced or structural modifications such as destruction of the toner surface layer in adjustment of the adherence strength and the like may occur in some cases. In addition, the energy or time required for adhering the large-diameter external additives increases. As a result, there is limitation in increasing the adherence strength of the large-diameter external additives.

Furthermore, the liberated large-diameter external additives cause an alteration in the surface properties of the developer transporting member in the case of adhering them on a developer holding member (developer transporting member) such as a sleeve and the like. Since the developer transporting member having the large-diameter external additives accumulated thereon has a decrease in the developer transporting ability, it becomes difficult to normally transport the developer in a development region, which may lead to a decrease in the amount of the toner to be developed or destabilization of the toner in some cases. As a result, these may be responsible for density unevenness and the like of the image in some cases.

In addition, in the case where a particle having high electrical resistance, such as a resin particle, a silica particle, and the like, is used for large-diameter external additives, when such large-diameter external additives having high electrical resistance are adhered on the surface of the developer transporting member, the electrical resistance of the developer transporting member increases, and accordingly, normal development potential cannot be applied to the development region, which makes the density unevenness of the image or the like more noticeable.

The large-diameter external additive is liberated from the toner particle surface by agitating or vibration in the developing unit. The liberated large-diameter external additive is repeatedly adhered in contact with and re-liberated from a structure, a member, or another toner surface in the developing unit, by agitating in the developing unit, and moves in the developing unit.

In order to improve the transporting property of the developer, the developer transporting member may be subjected to processing such as irregularities, grooves, and the like on the surface or a surface treatment such as resin coating, plating, and the like. The large-diameter external additives reaching the developer transporting member enter the irregularities or grooves of the surface, or are applied to the surface treatment, thereby contaminating the surface of the developer transporting member.

In view of this situation, in the present exemplary embodiment, the specific rugged particles are added to a developer. It is presumed that the action/function of the specific rugged particle will be as follows.

FIGS. 1A to 1D are conceptual views for explaining the action/function of a specific rugged particle. FIG. 1A shows a situation before adherence of the liberated external additive to the specific rugged particle, FIG. 1B shows a situation where the external additive is in contact with the outermost portion of the specific rugged particle, FIG. 1C shows a situation where the external additive moves to the concave portion of the specific rugged particle, and FIG. 1D shows a situation where the external additive is captured in the inside from the envelope of the specific rugged particle, respectively.

The specific rugged particle has many large irregularities on the surface as shown in FIGS. 1A to 1D.

The liberated large-diameter external additive (FIG. 1A) is brought into the surface of the specific rugged particle by stirring in the developing unit (FIG. 1B), and moves to the concave portion of the specific rugged particle (FIG. 1C). By stirring in the developing unit, the specific rugged particle is brought into a carrier, a structure in the developing unit, a member, or the like, and therefore, the large-diameter external additive moves to the concave portion of the specific rugged particle while rolling and slipping on the specific rugged particle surface. The large-diameter external additive which moves to the concave portion of the specific rugged particle exists in the inside from the envelope bonded with the outermost portion of the rugged particle (FIG. 1D), and accordingly, there is no case where it moves from the specific rugged particle to other toners, carriers, members, or structures of the developing unit. That is, it is presumed that the specific rugged particle has an immobilization action of the liberated large-diameter external additive (function of catching and holding the large-diameter external additive in the concave portion of the rugged particle) and that contamination of the developer transporting portion, the member, or the carrier with the liberated large-diameter external additive may be inhibited. As a result, it is presumed that the density unevenness of the image or the like due to liberated large-diameter external additive is inhibited.

Hereinafter, the toner and the rugged particle, or the carrier, which is used if necessary, of the developer of the present exemplary embodiment, will be described in detail.

Furthermore, in the case of including no carrier, the developer of the present exemplary embodiment is configured to be a single-component developer, whereas in the case of including a carrier, the developer of the present exemplary embodiment is configured to be a two-component developer.

—Toner—

The toner used in the present exemplary embodiment includes at least a colorant and a binder resin, and if necessary, toner particles which may include other components such as a release agent and the like, and external additives. The number average particle diameter of at least one kind of the external additives is 100 nm or more and 800 nm or less.

The binder resin is not particularly limited, but examples thereof include styrenes such as styrene, para-chlorostyrene, α-methylstyrene, and the like; esters having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, and the like; vinyl nitriles such as acrylonitrile, methacrylonitrile, and the like; vinyl ethers such as vinyl methyl ether, vinyl isobutyl ether, and the like; vinyl ketones such as vinyl methyl ketone, vinyl ethyl ketone, vinyl isopropenyl ketone, and the like; homopolymers such as polyolefins formed from monomers such as ethylene, propylene, butadiene, and the like, and copolymers obtainable by mixing two or more of these monomers; and mixtures thereof. Further examples include an epoxy resin, a polyester resin, a polyurethane resin, a polyamide resin, a cellulose resin, a polyether resin, a non-vinyl condensed resin; or mixtures of these with the above-described vinyl resins; graft polymers obtained by polymerizing vinyl-based monomers in the co-presence of these monomers; and the like.

A styrene resin, a (meth)acrylic resin, and styrene-(meth) acrylic copolymer resin are obtained by, for example, a known method using a styrene-based monomer and a (meth) acrylic acid-based monomer alone or in an appropriate combination. Further, the "(meth)acrylic" is an expression including both "acrylic" and "methacrylic".

The polyester resin is obtained by selecting a suitable combination of monomers from dicarboxylic acid components and diol components, and synthesizing the resin by using a conventionally known method such as a transesterification method, a polycondensation method, and the like.

When a styrene resin, a (meth) acrylic resin and copolymer resins of these are used as binder resins, it is preferable to use a resin having a weight average molecular weight Mw in the range of 20,000 or more and 100,000 or less, and a number average molecular weight Mn in the range of 2,000 or more and 30,000 or less. On the other hand, when a polyester resin is used as a binder resin, it is preferable to use a resin having a weight average molecular weight Mw in the range of 5,000 or more and 40,000 or less, and a number average molecular weight Mn of 2,000 or more and 10,000 or less.

The glass transition temperature of the binder resin is preferably in the range of 40° C. or higher and 80° C. or lower. By setting the glass transition temperature in the above-described range, the heat blocking resistance and the lowest fixing temperature are appropriately maintained.

As for the colorant, examples of a cyan colorant include cyan pigments such as C. I. Pigment Blue 1, C. I. Pigment Blue 2, C. I. Pigment Blue 3, C. I. Pigment Blue 4, C. I. Pigment Blue 5, C. I. Pigment Blue 6, C. I. Pigment Blue 7, C. I. Pigment Blue 10, C. I. Pigment Blue 11, C. I. Pigment Blue 12, C. I. Pigment Blue 13, C. I. Pigment Blue 14, C. I. Pigment Blue 15, C. I. Pigment Blue 15:1, C. I. Pigment Blue 15:2, C. I. Pigment Blue 15:3, C. I. Pigment Blue 15:4, C.I. Pigment Blue 15:6, C. I. Pigment Blue 16, C. I. Pigment Blue 17, C. I. Pigment Blue 23, C. I. Pigment Blue 60, C.I. Pigment Blue 65, C. I. Pigment Blue 73, C. I. Pigment Blue 83, C. I. Pigment Blue 180, C. I. Vat Cyan 1, C. I. Vat Cyan 3, C. I. Vat Cyan 20, and the like; Prussian Blue, Cobalt Blue, Alkali Blue Lake, Phthalocyanine Blue, metal-free Phthalocyanine Blue, partial chlorination products of Phthalocyanine Blue, Fast Sky Blue, and Indanthrene Blue BC; and cyan dyes such as C. I. Solvent Cyan 79 and 162, and the like.

Examples of a magenta colorant include magenta pigments such as C. I. Pigment Red 1, C. I. Pigment Red 2, C. I. Pigment Red 3, C. I. Pigment Red 4, C. I. Pigment Red 5, C. I. Pigment Red 6, C. I. Pigment Red 7, C. I. Pigment Red 8, C. I. Pigment Red 9, C. I. Pigment Red 10, C. I. Pigment Red 11, C. I. Pigment Red 12, C. I. Pigment Red 13, C. I. Pigment Red 14, C. I. Pigment Red 15, C. I. Pigment Red 16, C. I. Pigment Red 17, C. I. Pigment Red 18, C. I. Pigment Red 19, C. I. Pigment Red 21, C. I. Pigment Red 22, C. I. Pigment Red 23, C. I. Pigment Red 30, C. I. Pigment Red 31, C. I. Pigment Red 32, C.I. Pigment Red 37, C. I. Pigment Red 38, C. I. Pigment Red 39, C. I. Pigment Red 40, C. I. Pigment Red 41, C. I. Pigment Red 48, C. I. Pigment Red 49, C. I. Pigment Red 50, C.I. Pigment Red 51, C. I. Pigment Red 52, C. I. Pigment Red 53, C. I. Pigment Red 54, C.I. Pigment Red 55, C. I. Pigment Red 57, C. I. Pigment Red 58, C. I. Pigment Red 60, C. I. Pigment Red 63, C. I. Pigment Red 64, C. I. Pigment Red 68, C. I. Pigment Red 81, C. I. Pigment Red 83, C. I. Pigment Red 87, C. I. Pigment Red 88, C. I. Pigment Red 89, C. I. Pigment Red 90, C. I. Pigment Red 112, C. I. Pigment Red 114, C.I. Pigment Red 122, C. I. Pigment Red 123, C. I. Pigment Red 163, C. I. Pigment Red 184, C. I. Pigment Red 202, C. I. Pigment Red 206, C. I. Pigment Red 207, C. I. Pigment Red 209, and the like; magenta pigments such as C. I. Pigment Violet 19; magenta dyes such as C. I. Solvent Red 1, C. I. Solvent Red 3, C. I. Solvent Red 8, C. I. Solvent Red 23, C. I. Solvent Red 24, C. I. Solvent Red 25, C. I. Solvent Red 27, C. I. Solvent Red 30, C. I. Solvent Red 49, C. I. Solvent Red 81, C. I. Solvent Red 82, C. I. Solvent Red 83, C. I. Solvent Red 84, C. I. Solvent Red 100, C. I. Solvent Red 109, C. I. Solvent Red 121, C. I. Disperse Red 9, C. I. Basic Red 1, C. I. Basic Red 2, C. I. Basic Red 9, C. I. Basic Red 12, C. I. Basic Red 13, C. I. Basic Red 14, C. I. Basic Red 15, C. I. Basic Red 17, C. I. Basic Red 18, C. I. Basic Red 22, C. I. Basic Red 23, C. I. Basic Red 24, C. I. Basic Red 27, C. I. Basic Red 29, C. I. Basic Red 32, C. I. Basic Red 34, C. I. Basic Red 35, C. I. Basic Red 36, C. I. Basic Red 37, C. I. Basic Red 38, C. I. Basic Red 39, C. I. Basic Red 40, and the like; Bengara, Cadmium Red, minium, mercury sulfide, cadmium, Permanent Red 4R, Lithol Red, Pyrazolone Red, Watching Red, calcium salts, Lake Red D, Brilliant Carmine 6B, Eosin Lake, Rhodamine Lake B, Alizarin Lake, Brilliant Carmine 3B, and the like.

Furthermore, examples of a yellow colorant include yellow pigments such as C. I. Pigment Yellow 2, C. I. Pigment Yellow 3, C. I. Pigment Yellow 15, C. I. Pigment Yellow 16, C. I. Pigment Yellow 17, C. I. Pigment Yellow 97, C. I. Pigment Yellow 180, C. I. Pigment Yellow 185, C. I. Pigment Yellow 139, and the like.

In addition, in the case of a black toner, as the colorant, for example, carbon black, activated carbon, titanium black, magnetic powders, Mn-containing non-magnetic powders, and the like may be used.

As the colorant, a colorant which is subjected to a surface treatment, if necessary, may be used, or may be used in combination with a dispersant. In addition, plural kinds of the colorants may be used in combination with each other.

The amount of the colorant is preferably in the range of 1 part by mass or more and 30 parts by mass or less, relative to 100 parts by mass of the binder resin.

In addition, the toner particles used in the present exemplary embodiment preferably contain a charge control agent, and may use nigrosine, a quaternary ammonium salt, an organic metal complex, a chelate complex, and the like. Further, as the external additive, silica, titanium oxide, barium titanate, fluorine particles, acryl particles, and the like may be used in combination with each other. Examples of the silica include commercially available products such as TG820 (manufactured by Cabot Corporation), HVK2150 (manufactured by Clariant), and the like.

Moreover, the toner particles used in the present exemplary embodiment preferably contain a release agent, and examples of the release agent include an ester wax, a polyethylene, a polypropylene, a copolymerization product of a polyethylene and a polypropylene, a polyglycerin wax, a microcrystalline wax, a paraffin wax, a carnauba wax, a sasol wax, a montanic ester wax, a deoxidized carnauba wax, unsaturated fatty acids such as palmitic acid, stearic acid, montanic acid, brassidic acid, eleostearic acid, parinaric acid, and the like, saturated alcohols such as stearin alcohol, aralkyl alcohol, behenyl alcohol, carnaubyl alcohol, ceryl alcohol, melissyl alcohol, or long-chain alkyl alcohols having a long chain alkyl group, and the like; polyhydric alcohols such as sorbitol and the like; fatty acid amides such as linoleic acid amide, oleic acid amide, lauric acid amide, and the like; saturated fatty acid bisamides such as methylene bisstearic acid amide, ethylene biscapric acid amide, ethylene bislauric acid amide, hexamethylene bisstearic acid amide, and the like; unsaturated fatty acid amides such as ethylene bisoleic acid amide, hexamethylene bisoleic acid amide, N,N'-dioleyladipic acid amide, N,N'-dioleylsebacic acid amide, and the like; aromatic bisamides such as m-xylenebisstearic acid amide, N,N'-distearylisophthalic acid amide, and the like; fatty acid metal salts (those generally called metal soaps) such as calcium stearate, calcium laurate, zinc stearate, magnesium stearate, and the like; waxes obtained by grafting a vinyl monomer such as styrene, an acrylic acid, and the like onto an aliphatic hydrocarbon type wax; partially esterified products of a fatty acid such as behenic acid monoglyceride, a polyhydric alcohol, and the like; methyl ester compounds having a hydroxyl group and the like, obtained by hydrogenation of a vegetable oil, and the like.

The volume average particle diameter of the toner particles is preferably in the range of 2 μm or more and 10 μm or less, and more preferably 3 μm or more and 8 μm or less.

The volume average particle diameter of the toner particles is measured, for example, as follows: 0.5 mg of a measurement sample is added to 2 ml of a 5% aqueous solution of a surfactant (sodium dodecylbenzenesulfonate) as a dispersant, and the solution is added to 100 ml of an electrolytic solution (ISOTON-II, manufactured by Beckman Coulter, Inc.). This electrolytic solution in which the measurement sample is suspended is subjected to a dispersion treatment using an ultrasonic dispersing machine for 1 minute, and the volume and the number of the toner particles are classified with respect to cumulative distribution according to particle ranges (channel) partitioned based on the particle size distribution, as measured by COULTER MULTISIZER-II (manufactured by Beckman Coulter, Inc.) using an aperture having an aperture diameter of 100 μm, and the volume and the number of the toner particles at cumulative counts of 50% are defined as volume D50v and number D50p, respectively. The number of particles to be measured is 50,000. Unless otherwise specified, the volume D50v is used as a volume average particle diameter of the toner particles.

The toner particles used in the present exemplary embodiment are desired to have an average shape factor in the range of 100 or more and 140 or less (or about 100 or more and about 140 or less), and preferably in the range of 110 or more and 140 or less (or about 110 or more and about 140 or less).

As for the shape of the toner, the spherical shape toner is advantageous in terms of the developability and transferability, but may be deteriorated as compared with the amorphous shape in terms of the cleaning property. When the toner is in the shape having the range as above, the transfer efficiency and the denseness of the image are improved, and an image having high image quality is formed, and the cleaning property of the photoreceptor surface is also enhanced.

The average shape factor is more preferably in the range of 120 or more and 135 or less.

Herein, the shape factor is determined by the following formula (2).

$$\text{Shape Factor SF1}=(ML^2/A)\times(\pi/4)\times 100 \quad (2)$$

wherein ML represents the absolute maximum length of the toner particles, A represents the projected area of the toner particle, and $\pi$ represents a ratio of the circumference, and is smallest with SF1=100 in the case of a sphere.

The average shape factor is usually numerically expressed by imaging using a microphotograph or a scanning electron microphotograph (SEM: for example, S-4100 manufactured by Hitachi Ltd., and the like) and analyzing the image obtained using an image analyzer (for example, LUZEX III manufactured by Nireco Corporation), and then calculated, for example, in the following manner. That is, a method in which an optical microscope image of the particles scattered on the surface of a slide glass is taken into a Luzex image analyzing apparatus through a video camera is also available. The images of 300 particles are put into the image analyzer and the shape factor of each particle is calculated according to formula (2) above to determine its average value.

Next, the external additive will be described.

In the present exemplary embodiment, at least one kind of the external additives that are externally added to the toner may be large-diameter external additives which have a number average particle diameter of 100 nm or more and 800 nm or less (or about 100 nm or more and about 800 nm or less), preferably 120 nm or more and 700 nm or less (or about 120 nm or more and about 700 nm or less), and more preferably 140 nm or more and 500 nm or less (or about 140 nm or more and about 500 nm or less).

If the number average particle diameter of all the external additives is less than 100 nm, the external additives are easily embedded in the toner particles, and accordingly, transfer maintenance or the like may be lost in some cases. On the other hand, if the number average particle diameter of all the external additives is more than 800 nm, the external additive is not easily adhered to the toner particle surface and there is a decrease in the amount of the external additives present on the toner particle surface from an initial time, and accordingly, transfer maintenance or the like may be lost in some cases.

Liberation of the large-diameter external additive from the toner particle surface, and correspondingly, generation of contamination of the developer transporting member are more noticeable, in a case where the external additives are toner particles having from a spherical shape to a potato shape (having an average shape factor SF1 in the range of 100 or more and 140 or less), which are difficult to be fixed on the surface. In the case of a combination of the toner particles and the large-diameter external additives, generation of the image defects is more efficiently inhibited by addition of the rugged particles according to the present exemplary embodiment.

The number average particle diameter of the external additives is determined as follows. The external additives are observed using a scanning electron microscope (for example, S-4100 manufactured by Hitachi Ltd.), and the like, and imaged, and the obtained image is put into an image analyzer (for example, LUZEX III, manufactured by Nireco Corporation), the circle-equivalent diameters of the 300 primary particles are measured, and an average value thereof is determined and taken as a number average particle diameter of the primary particles. Further, the electron microscope is adjusted to capture approximately 10 or more and 50 or less external additives in one view field, and observed in plural view fields to determine a circle-equivalent diameter of the primary particle.

Examples of the large-diameter external additive include metal oxide particles (for example, silica particles, titania particles, alumina particles, cerium oxide particles, and the like), resin particles (for example, polystyrene particles, acrylic resin particles, polyester particles, polyurethane particles, crosslinking resin particles, and the like), composite particles (for example, strontium titanate particles, calcium titanate particles, silicon carbide particles, and the like). These may be used singly or in combination of two or more kinds thereof.

In these particles, as the large-diameter external additives, for example, silica particles are preferable from the viewpoints of strength, little influence on color gamut, safety, cost, and the like, and silica particles by a sol-gel method or a wet method are particularly preferable from the viewpoint of a property of controlling the particle diameter particle size distribution.

Furthermore, these particles may be surface-treated. Examples of the surface treatment include surface treatments using a coupling agent (for example, a silane-based coupling agent, a titanate-based coupling agent, and the like), silicon oil, fatty acid metal salts, charge control agents, and the like.

The amount of the large-diameter external additives is preferably 0.5 part by mass or more and 5 parts by mass or less (or about 0.5 part by mass or more and about 5 parts by mass or less), and more preferably 1 part by mass or more and 3 parts by mass or less, relative to 100 parts by mass of the toner particles.

In the present exemplary embodiment, other external additives may be used in combination, in addition to the large-diameter external additives. Examples of the other external additive include external additives having a number average particle diameter of less than 50 nm (preferably 5 nm or more and 30 nm or less) (which may be hereinafter referred to as a small-diameter external additive).

Examples of the small-diameter external additive include silica particles, alumina particles, titanium oxide particles, barium titanate particles, magnesium titanate particles, calcium titanate particles, strontium titanate particles, zinc oxide particles, silica sand particles, clay particles, mica particles, wollastonite particles, diatomaceous earth particles, cerium chloride particles, red iron oxide particles, chromium oxide particles, cerium oxide particles, antimony trioxide particles, magnesium oxide particles, zirconium oxide particles, silicon carbide particles, silicon nitride particles, calcium carbonate particles, magnesium carbonate particles, calcium phosphate particles, and the like.

The amount of the other external additives to be added is preferably 0.3 part by mass or more and 3.0 parts by mass or less, relative to 100 parts by mass of the toner particles.

Herein, the toner may be obtained by preparing the toner particles, and then adding the external additive to the toner particles.

The method for preparing the toner particles is not particularly limited, but the toner particles are prepared by a dry method such as a known kneading/pulverizing preparation method and the like, a wet method such as an emulsification aggregation method, a suspension polymerization method, and the like. Among these methods, an emulsification aggregation method in which the shapes of the toner particles or the particle diameters of the toner particles are easily controlled and there is a wide range of the toner particle structures such as a core/shell structure and the like to be controlled is wide is preferable. Hereinafter, the method for preparing the toner particles by an emulsification aggregation will be described in detail.

The emulsification aggregation method according to the present exemplary embodiment includes emulsifying a raw material constituting the toner particles to form resin particles (emulsified particles), performing aggregation to form aggregates of the resin particles, and performing coalescing the aggregates.

(Emulsification)

Preparation of the resin particle dispersion may be performed by emulsifying a solution in which an aqueous medium and a binder resin are mixed by applying a shear force with a dispersion machine, in addition to production of a resin particle dispersion by a general polymerization method, for example, an emulsification polymerization method, a suspension polymerization method, a dispersion polymerization method, and the like. At this time, by lowering the viscosity of a resin component by heating, the particles may be formed. Further, a dispersant may be used in order to stabilize the dispersed resin particle. Further, if a resin is oily and dissolved in a solvent having a relatively low solubility in water, the resin is dissolved in such a solvent and finely dispersed in water together with a dispersant and a polymeric electrolyte, and then the solvent is evaporated by heating or reducing the pressure to prepare a resin particle dispersion.

Examples of the aqueous medium include water such as distilled water, deionized water, and the like; alcohols; and the like, and water only is preferable.

Examples of the dispersant used in the emulsification include water-soluble polymers such as polyvinyl alcohol, methyl cellulose, ethyl cellulose, hydroxyethyl cellulose, carboxymethyl cellulose, sodium polyacrylate, sodium polymethacrylate, and the like; surfactants, for example, anionic surfactants such as sodium dodecylbenzenesulfonate, sodium octadecylsulfate, sodium oleate, sodium laurate, potassium stearate, and the like, cationic surfactants such as laurylamine acetate, stearylamine acetate, lauryltrimethyl ammonium chloride, and the like, amphoteric surfactants such as lauryldimethylamine oxide, nonionic surfactants such as polyoxyethylene alkyl ether, polyoxyethylene alkyl phenyl ether, polyoxyethylene alkyl amine, and the like; and inorganic salts such as tricalcium phosphate, aluminum hydroxide, calcium sulfate, calcium carbonate, barium carbonate, and the like.

Examples of the dispersing machine used in the preparation of the emulsified liquid include a homogenizer, a homomixer, a pressure kneader, an extruder, a media-dispersing machine, and the like. The size of the resin particles, in terms of the average particle diameter (volume average particle diameter) is preferably 1.0 μm or less, more preferably in the range of 60 nm or more and 300 nm or less, and still more preferably in the range of 150 nm or more and 250 nm or less. If the size is less than 60 nm, the resin particles become stable in the dispersion, and thus aggregation of the resin particles may be difficult in some cases. Further, if the size is more than 1.0 μm the aggregation property of the resin particles may be improved, and thus, the toner particles are easily produced, but the particle diameter distribution of the toner may be widen in some cases.

During the preparation of the release agent dispersion, the release agent is dispersed in water, together with ionic surfactants, polymer electrolytes such as a polymer acid, a polymer base, and the like, and then heating to a temperature no lower than the melting temperature of the release agent, and at the same time, a dispersion treatment is performed using a homogenizer or a pressure-discharging dispersing machine with strong shearing force. By performing such a treatment, a release agent dispersion may be obtained. During the dispersion treatment, inorganic compounds such as polyaluminum chloride and the like may be added to the dispersion. Examples of the preferable inorganic compound include polyaluminum chloride, aluminum sulfate, a highly basic polyaluminum chloride (BAC), polyaluminum hydroxide, aluminum chloride, and the like. Among these, polyaluminum chloride, aluminum sulfate, and the like are preferable. The release agent dispersion is used in an emulsification aggregation method, but even when the toner is prepared in the suspension polymerization method, the release agent dispersion may be used.

By a dispersion treatment, a release agent dispersion containing a release agent particle having a volume average particle diameter of 1 μm or less may be obtained. Further, the volume average particle diameter of the release agent particle is more preferably 100 nm or more and 500 nm or less.

If the volume average particle diameter is less than 100 nm, the characteristics of the binder resin to be used are also affected, but generally, the components of the release agent become difficult to be incorporated in the toner. Further, if the volume average particle diameter is more than 500 nm, the dispersion state of the release agent in the toner becomes insufficient in some cases.

For preparation of the colorant dispersion, a known dispersion method may be used, general dispersion units such as a rotary shear-type homogenizer, a ball mill having media, a sand mill, a Dynomill, an Altimizer, and the like may be adopted, but are not limited thereto. The colorant is dispersed in water, together with an ionic surfactant, and a polymer electrolyte such as a polymer acid, a polymer base, and the like. The volume average particle diameter of the colorant particles dispersed may be 1 or less, but if it is in the range of 80 nm or more and 500 nm or less, the aggregation property is not impaired and the dispersion of the colorant in the toner is good, which is thus preferable.

(Aggregation)

In the aggregation, a resin particle dispersion, a colorant dispersion, a release agent dispersion, and the like are mixed to give a mixed liquid, and heated to the glass transition temperature of the resin particle or lower to perform aggregation, thereby forming an aggregated particle. Formation of the aggregated particle may be performed by acidification of the pH of the mixing liquid under stirring in many cases. The pH is preferably in the range of 2 or more and 7 or less, at which an aggregation agent may also be effectively used.

Furthermore, in the aggregation, the release agent dispersion may be added and mixed at once together with various dispersions such as a resin particle dispersion and the like, or dividedly added several times.

As the aggregation agent, a divalent or higher-valent metal complex is suitably used, in addition to a surfactant used as the dispersant as above, a surfactant having reverse polarity, an inorganic metal salt. Particularly, in the case where a metal complex is used, the amount of the surfactant to be used may be reduced, and the charging characteristics are improved, which is thus particularly preferable.

As the inorganic metal salt, aluminum salts and polymers thereof are particularly preferable. For attaining a narrower particle size distribution, the valence of the inorganic metal salt is more preferably divalent than monovalent, trivalent than divalent, or tetravalent than trivalent, and further, in the case of the same valences as each other, a polymer-type inorganic metal salt polymer is more suitable.

In the present exemplary embodiment, it is preferable to use a polymer of a salt of tetravalent inorganic metals including aluminum in order to obtain a narrow particle size distribution.

Furthermore, even when the aggregated particle has a desired particle diameter, the resin particle dispersion may be further added (coating) to prepare a toner configured to having the surface of a core aggregated particle coated with a resin. In this case, the release agent or the colorant becomes difficult to be exposed to the toner surface, and thus, has a configuration which is preferable in terms of a charging property or a developing property. In the case of further addition, an aggregation agent may be added or pH may be adjusted before further addition.

(Coalescence)

In the coalescence, by increasing the pH of the suspension of the aggregated particles to 3 or more and 9 or less under the stirring condition according to the aggregation, advance of the aggregation is stopped, and by heating the resin to the glass transition temperature or higher, the aggregated particles are coalesced. Further, in the case of coating with the resin, the resin is also coalesced, the core aggregated particle is coated. The time of heating may be any time at which coalescence is performed, and the heating may be performed for 0.5 hour or more and 10 hours or less.

After coalescence, cooling is performed to obtain coalesced particle. Further, by the cooling, lowering of the cooling rate around the glass transition temperature of the resin (a range in the glass transition temperature ±10° C.), that is, a so-called slow cooling, may be performed to promote crystallization.

The coalesced particle obtained by the coalescence is subjected to a solid-liquid separation such as filtration and the like, or if necessary, a washing or a drying to give toner particles.

Examples of externally adding the external additives to the toner particles include methods involving mixing by a known mixer such as a V-type blender, a Henschel mixer, a Redige mixer, and the like.

—Rugged Particles—

The rugged particle used in the present exemplary embodiment is a particle having a rate of ruggedness represented by formula (1) of 30% or more and 70% or less (or about 30% or more and about 70% or less).

If the rate of ruggedness of the rugged particle is less than 30%, the rugged degree of the rugged particle is small, and thus, the immobilization action of the large-diameter external additive by the rugged particle may not be exerted in some cases. On the other hand, if the rate of ruggedness is more than 70%, and thus the particle strength of the rugged particle is low and the rugged particle is destroyed by stirring in the developing unit, the immobilization action of the large-diameter external additive by the rugged particle may not be exerted in some cases.

The rate of ruggedness of the rugged particle is preferably 35% or more and 65% or less (or about 35% or more and about 65% or less), and more preferably 35% or more and 60% or less (or about 35% or more and about 60% or less).

Herein, the method for measuring the rate of ruggedness in the present exemplary embodiment is described with reference to FIG. 1D.

In FIG. 1D, a specific rugged particle, and an envelope binding the convex portion of the rugged particle so as to surround the specific rugged particle are shown. The projected area inside the envelope is designated as an envelope area. Based on the envelope area and the projected area of the specific rugged particle, the rate of ruggedness is determined from formula (1).

The envelope area and the projected area of the specific rugged particle are specifically determined, for example, in the following manner.

A measurement liquid, in which a measurement sample (developer) is added to a 5% aqueous solution of a surfactant as a dispersant (sodium dodecylbenzenesulfonate) and dispersed using an ultrasonic dispersing machine, is produced. Using a measurement device FPIA 3000 (manufactured by SISMECS Co., Ltd.), 300 or more particles are measured to determine an envelope rate (area).

In the case where the measurement sample includes toner particles, similarly, by using a measurement device FPIA 3000 (manufactured by SISMECS Co., Ltd.), 50000 particles in the measurement liquid are measured, and particles having an envelope rate (area) of 30% or more are extracted. Thus, the rate of ruggedness of each particle having an envelope rate (area) of 30% or more is determined and an average thereof is taken as a rate of ruggedness of the specific rugged particle.

In the case where the measurement sample includes magnetic carrier particles and toner particles, a magnetic carrier particle is removed from a dispersion using a magnet in which the sample is dispersed in a 5% aqueous solution of a surfactant (sodium dodecylbenzenesulfonate) to give a measurement liquid. By using a measurement device FPIA 3000 (manufactured by SISMECS Co., Ltd.), 50000 particles are measured in the measurement liquid, a rate of ruggedness of each particle with an envelope rate (area) of 30% or more is determined and an average thereof is taken as a rate of ruggedness of the specific rugged particle. Similarly, for the particle having an envelope rate (area) of 30% or more, the average value of the maximum length is determined, which is taken as an average long-axis diameter of the specific rugged particle. Further, the number of the particles having an envelope rate (area) of 30% or more is counted, which is taken as % by number, relative to the toner particles.

In the present exemplary embodiment, the amount of the rugged particles is preferably 0.05% by number or more and 10% by number or less (or about 0.05% by number or more and about 10% by number or less), and more preferably 0.1% by number or more and 9% by number or less (or about 0.1% by number or more and about 9% by number or less), relative to the toner particles. If the amount of the rugged particles is less than 0.05% by number, the efficiency of immobilization of the large-diameter external additives by the rugged particles is lowered, and the immobilization action of the large-diameter external additives by the rugged particles may not be exerted in some cases. If the amount of the rugged particles is more than 10% by number, the stirring/mixing property of the developer in the developing unit is reduced, and thus, there may be cases where the charging characteristics of the developer are deteriorated or the flowability of the toner for distribution is lowered and the amount of the toner for distribution is destabilized, and thus, there occurs excess distribution or insufficient supply of the toner.

In the present exemplary embodiment, the average long-axis diameter of the rugged particles is preferably 1.0 time or more, and more preferably 1.2 times or more and 10 times or less (or about 1.2 times or more and about 10 times or less) the volume average particle diameter of the toner particles. If the average long-axis diameter of the rugged particles is less than 1.2 times the volume average particle diameter of the toner particles, the immobilization action of the large-diameter external additives by the rugged particles may not be exerted in some cases. If the average long-axis diameter of the toner particles is more than 10 times, there may be cases where rugged particles are filled up in a layer control part of the developer transporting unit, and thus, deficiency or unevenness in the developer transport occurs.

The material constituting the rugged particle is not particularly limited, but may be an organic material or inorganic material.

Specific examples of the organic material include resins such as a polystyrene resin, an acrylic resin, a polyester resin, a silicone resin, and the like, organic materials such as higher alcohols, fatty acids, fatty acid metal salts, and the like.

Specific examples of the inorganic material include inorganic materials including metal oxides such as silica, titania, alumina, zinc oxide, and the like, and metal acid salts such as strontium titanate, calcium titanate, barium titanate, and the like.

In addition, a composite particle of an organic material and an inorganic material is also allowed.

In the present exemplary embodiment, the rugged particle more preferably has a crystalline resin, a wax, or an organic substance, each of which has a melting temperature of 50° C. or higher and 90° C. or lower. By incorporating such a substance into the rugged particle, an adhesive force increases by a mechanical pressure, and thus, the immobilization action of the liberated large-diameter external additive further increases.

The melting temperature is measured at a temperature rising rate of 10° C. per minute from room temperature (for example, 25° C.) to 150° C. using a differential scanning calorimeter (DSC). The melting temperature is measured as a melting maximum absorption temperature in the differential analysis measurement according to ASTM D3418-8 in the DSC measurement. Further, in the measurement above, plural times of melting maximum absorption may be shown in some cases, but in the present exemplary embodiment, a highest maximum absorption temperature is considered as a melting temperature.

The method for preparing the rugged particles is not particularly limited, but is chosen according to the type of material constituting the rugged particle.

Specific examples of the method for preparing the rugged particles include, as a method for producing the toner particles by the emulsification aggregation method as described above, a method in which the pH or the aggregation agent is controlled during aggregation, a method in which a capsule particle having a solvent inside is dried and contracted, a method in which a mixture of two kinds of resins is made into particles by a kneading/pulverizing method, and then the resins are removed in a solution in which one resin only is dissolved, a method in which a resin particle and an abrasive particle are collided with each other in an air flow to produce irregularities on the surface of the resin particle, a method in which irregularities are produced on the surface of the particle by an electronic beam, etching, and the like, a method in which a product formed by kneading a resin material and a metal powder is pulverized to give fine particles, and the fine particles are placed in an acidic liquid such as hydrochloric acid and the like to dissolve and remove the metal powder on the fine particle surface, thereby forming irregularities on the fine particle surface, and the like.

In addition, in the above-described methods, a method in which the rugged particles are produced singly and added to a toner or a developer, a method in which in the toner production, parts of the material components of the toner are used while forming the toner particles to produce rugged particles, and other methods may also be used.

Figure 2:
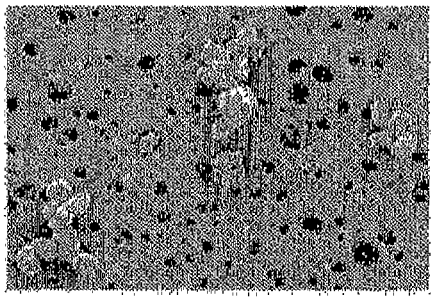
FIG. 2 is an electron micrograph showing the specific example of a rugged particle according to the present exemplary embodiment.

FIG. 2 is an electron micrograph (magnification 10000 times) showing a specific example of the rugged particle according to the present exemplary embodiment. The rugged particle shown in FIG. 2 is one prepared by using a polyester resin as a material and adopting an emulsification aggregation method.

The rugged particle may be any one which is present in the developing unit together with a toner or the like, and for a two-component developer, any method selected from, for example, a method in which a rugged particle is accommodated together with a two-component developer including a toner and a carrier in a developing unit, a method in which a rugged particle is included in a toner for distribution, a method in which a developing unit includes a device for adding a rugged particle, apart from a toner supply device, and the like may be used. With a single-component developer, similarly, the rugged particle may be any one which is present in a developing unit together with a toner.

—Carrier—

The developer of the present exemplary embodiment may contain a carrier, if necessary. The carrier that may be used in the developer of the present exemplary embodiment is not particularly limited, and a known carrier is used. Examples thereof include magnetic metals such as iron, nickel, cobalt, and the like, magnetic oxides such as ferrite, magnetite, and the like, a resin-coated carrier having a resin coating layer on a surface of a core material thereof, a magnetic dispersion-type carrier, and the like. Further, the carrier may be a resin dispersion-type carrier in which a conductive material or the like is dispersed in a matrix resin.

Examples of the coated resin/matrix resin used for the carrier include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, straight silicone resin comprising organosiloxane bonds or a modified product thereof, a fluorinated resin, a polyester, a polycarbonate, a phenolic resin, an epoxy resin, and the like, but are not limited thereto.

Examples of the conductive material include metals such as gold, silver, copper, and the like, carbon black, titanium oxide, zinc oxide, barium sulfate, aluminum borate, potassium titanate, tin oxide, and the like, but are not limited thereto.

Examples of the core material of the carrier include magnetic metals such as iron, nickel, cobalt, and the like, magnetic oxides such as ferrite, magnetite, and the like, glass beads, etc. In order to use the carrier in a magnetic brush method, the core material may be a magnetic material.

The volume average particle diameter of the core materials of the carrier is generally in the range of 10 μm or more and 500 μm or less, and preferably 20 μm or more and 100 μm or less, in view of attaining high image quality and stability of the image quality.

Moreover, examples of methods for coating the surface of the core material of the carrier with a resin include a method including applying, to the surface of the core material, a coating liquid for forming the resin layer in which the resin and various additives, if necessary, are dissolved in an appropriate solvent. The solvent is not particularly limited, but may be selected as appropriate in consideration of the coating resin to be used, suitability for coating, and the like.

Specific examples of the resin coating method include a dipping method in which the core material of the carrier is dipped in the coating liquid, a spray method in which the coating liquid is sprayed onto the surface of the core material of the carrier, a fluidized bed method in which the coating liquid is sprayed onto the core material of the carrier that is floated by fluidizing air, and a kneader coater method in which the core material of the carrier is mixed with the coating liquid in the kneader coater and the solvent is removed.

In the present exemplary embodiment, it is preferable to use a carrier in which the surface of a magnetic carrier core material including at least ferrite or magnetite is coated with a resin-coated layer in which fine particles of a conductive material are dispersed, in view of adjustment of developability and stability over a long period of time, but not limited thereto.

The mixing ratio (ratio in terms of weight) of the toner to the carrier in the two-component developer is preferably in the range of about 1:100 to about 30:100, and is more preferably in the range of about 3:100 to about 20:100.

<Image Forming Apparatus and Image Forming Method>

Next, the image forming apparatus and the image forming method according to the present exemplary embodiment, using the developer of the present exemplary embodiment, will be described.

The image forming apparatus according to the present exemplary embodiment has a latent image holding member, a charging unit that charges the surface of the latent image holding member, a latent image forming unit that forms an electrostatic latent image on the surface of the latent image holding member, a developing unit that develops the electrostatic latent image by the developer of the present exemplary embodiment to form a toner image, a transfer unit that transfers the toner image to a recording medium, and a fixing unit that fixes the toner image on the recording medium. The image forming apparatus according to the present exemplary embodiment may be equipped with other means such as a cleaning unit that scrapes the latent image holding member to a cleaning member and removes the transferred residual components for cleaning, and the like, if desired.

By using the image forming apparatus according to the present exemplary embodiment, the image forming method according to the present exemplary embodiment, including charging the surface of a latent image holding member, forming an electrostatic latent image on the latent image holding member surface, developing the electrostatic latent image by the developer of the present exemplary embodiment to form a toner image, transferring the toner image to a recording medium, and fixing the toner image on the recording medium, is carried out.

Next, one example of the image forming apparatus according to the present exemplary embodiment will be illustrated, but is not limited thereto. Further, the main parts shown in the figures are explained, and description of the others is omitted.

Furthermore, in this image forming apparatus, for example, a section including the developing unit may be a cartridge structure (process cartridge) which is detachable from the main body of the image forming apparatus, the process cartridge according to the present exemplary embodiment, which includes a developer holding member and an accommodate chamber containing the developer of the present exemplary embodiment, is preferably used as a process cartridge.

Figure 3:
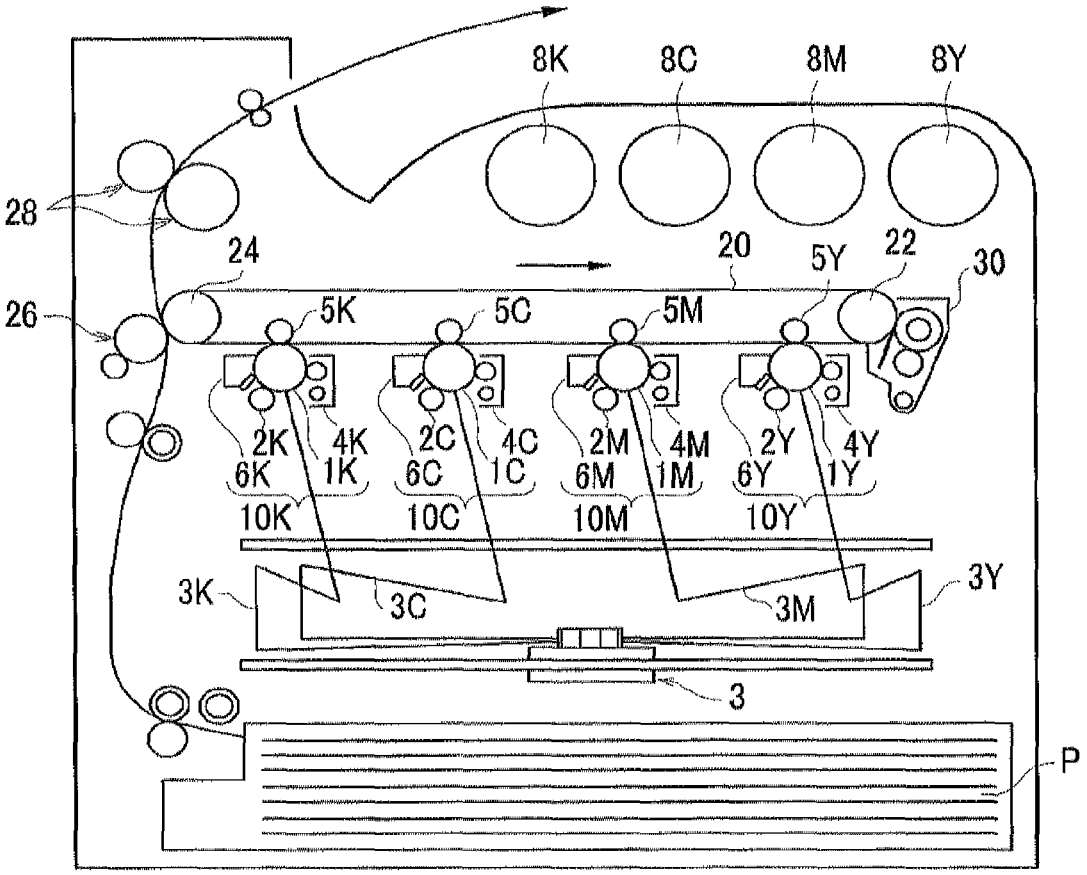
FIG. 3 is a schematic configuration diagram showing an example of an image forming apparatus of the present exemplary embodiment.

FIG. 3 is a schematic configuration diagram showing a 4-series tandem type color image forming apparatus which is one example of the image forming apparatus of the present exemplary embodiment. A two-component developer is used as the developer.

The image forming apparatus shown in FIG. 3 is equipped with first through fourth electrophotographic image foaming units 10Y, 10M, 10C, and 10K (image forming unit) for the output of an image of each color of yellow (Y), magenta(M), cyan(C), and black(K), based on the color-separated image data. These image forming units (hereinafter simply referred to as the "units") 10Y, 10M, 10C, and 10K are provided in parallel at a predetermined spacing in the horizontal direction. Also, these units 10Y, 10M, 10C, and 10K may be process cartridges which are detachable from the main body of the image forming apparatus.

An intermediate transfer belt 20 as an intermediate transfer member is disposed lengthwise through a respective unit at the upper part in the figure of the respective units 10Y, 10M, 10C, and 10K. The intermediate transfer belt 20 is provided as rolled by a driving roller 22 and a support roller 24 in contact with the inner surface of the intermediate transfer belt 20, which are disposed apart from each other, in the direction from the left side to the right side in the figures, and is configured to run from the first unit 10Y to the fourth unit 10K. Further, the support roller 24 is biased in the direction away from the driving roller 22 by a spring not shown in the figure, and a predetermined tension is given to the intermediate transfer belt 20 rolled by both of these rollers. Also, an intermediate transfer member cleaning device 30 is provided opposite to the driving roller 22 on the side of the image holding member of the intermediate transfer belt 20.

In addition, the developer for electrostatic photography including toners of four colors, yellow, magenta, cyan, and black, which are accommodated in the developer cartridges BY, 8M, 8C, and 8K, are supplied to the respective developing devices (developing units) 4Y, 4M, 4C, and 4K of the respective units 10Y, 10M, 10C, and 10K.

The first through fourth units 10Y, 10M, 10C, and 10K as described above have equivalent configurations, and accordingly, the representative first unit 10Y which forms a yellow image disposed upstream of the driving direction of the intermediate transfer belt is described herein. Further, the description of the second through the fourth units 10M, 10C, and 10K is omitted by noting the reference numerals with magenta (M), cyan (C), and black (K) instead of yellow (Y) in the parts equivalent to the first unit 10Y.

The first unit 10Y has a latent image holding member 1Y that functions as a photoreceptor. Around the latent image holding member 1Y, a charging roller 2Y which charges the surface of the latent image holding member 1Y to a predetermined potential, a light exposing device 3 which forms an electrostatic latent image through light exposure of the charged surface to a laser beam 3Y based on the color-separated image signal, a developing device (developing unit) 4Y which develops the electrostatic latent image by supplying the charged toner to the electrostatic latent image, a primary transfer roller 5Y (primary transfer unit) which transfers the developed toner image onto the intermediate transfer belt 20, and a latent image holding member cleaning device (cleaning unit) 6Y which removes the toner remaining on the surface of the latent image holding member 1Y after the primary transfer are sequentially provided.

In addition, the primary transfer roller 5Y is disposed on the inner side of the intermediate transfer belt 20 at a position opposite to the latent image holding member 1Y. In addition, the respective primary transfer rollers 5Y, 5M, 5C, and 5K are connected with a bias source (not shown) which applies the primary transfer bias. The respective bias source makes the transfer bias applied to the respective primary transfer roller variable through the control by a control section not shown in the figure.

The image forming apparatus shown in FIG. 3 is an image forming apparatus configured such that the developer cartridges 8Y, 8M, 8C, and 8K are detachable, and the developing devices 4Y, 4M, 4C, and 4K are connected to toner supply pipes (not shown) with the developer cartridges 8Y, 8M, 8C, and 8K, corresponding to the respective developing devices (colors). Further, the developing devices 4Y, 4M, 4C, and 4K may be connected with a developer discharging pipe not shown, for discharging the excess (including lots of deteriorated carriers) deteriorated developer. By such a configuration, a so-called trickle developing system (a developing system that performs development, which slowly supplies a developer for distribution (trickle developer) into a developing device while discharging excess deteriorated developers (including lots of deteriorated carriers) is employed.

In the case where developer cartridges 8Y, 8M, 8C, and 8K, which accommodate a developer for electrostatic photography, are employed, and the developer accommodated in the developer cartridge decreases, the developer cartridge is exchanged.

Hereinafter, an operation for forming a yellow image in the first unit 10Y will be described. First, prior to the operation, the surface of the latent image holding member 1Y is charged to a potential of approximately from −600 V to −800 V by using a charging roller 2Y.

The latent image holding member 1Y is formed by superimposing a photosensitive layer on a conductive substrate (having a volume resistivity at 20° C. of $1\times10^{-6}\Omega\cdot$cm or less). The photosensitive layer usually has a high resistance (comparable to the resistance of an ordinary resin), but has properties such that irradiation with a laser beam 3Y changes the specific resistance of a portion irradiated with the laser beam. The laser beam 3Y is outputted through an exposure device 3 onto a surface of the charged latent image holding member by in accordance with yellow image data transmitted from a controller (not shown). The laser beam 3Y is irradiated on the photosensitive layer at the surface of the latent image holding member 1Y, thereby forming an electrostatic latent image for a yellow printing pattern on the surface of the latent image holding member 1Y.

The electrostatic latent image is an image formed by charging on the surface of the latent image holding member 1Y and is a negative latent image formed by the following manner: the specific resistance of the irradiated portion of the photosensitive layer is lowered by the laser beam 3Y, as a result of which the electric charges on the surface of the latent image holding member 1Y flow out while the electric charges on a portion that is not irradiated by the laser beam 3Y remain thereon.

The electrostatic latent image thus formed on the latent image holding member 1Y is transported to a predetermined developing position owing to the rotation of the latent image holding member 1Y. Then, electrostatic latent image on the latent image holding member 1Y is visualized into a visual image (toner image) by a developing device 4Y at the developing position.

In the developing device 4Y, a yellow toner is stored. The yellow toner is friction-charged by being stirred inside the developing device 4Y, and the yellow toner having an electric charge of the same polarity (negative polarity) as that of electric charges provided by charging on the latent image holding member 1Y is retained on a developer roll (developer holding member). When the surface of the latent image holding member 1Y passes through the developing device 4Y, the yellow toner is electrostatically adhered onto a neutralized latent image portion on a surface of the latent image holding member 1Y, as a result of which the latent image is developed with the yellow toner. The latent image holding member 1Y with the thus formed yellow toner image run at a predetermined speed, and the toner image on the latent image holding member 1Y is transported to a predetermined primary transfer position.

When the yellow toner image on the latent image holding member 1Y is transported to the primary transfer position, a predetermined primary transfer bias is applied to a primary transfer roller 5Y, as a result of which an electrostatic force directing from the latent image holding member 1Y to the primary transfer roller 5Y works on the toner image, and the toner image on the latent image holding member 1Y is transferred onto an intermediate transfer belt 20. The applied transfer bias has polarity (+), which is opposite to the polarity (−) of the toner. For example, the transfer bias in the first unit 10Y is adjusted to approximately +10 μA by the controller (not shown).

On the other hand, the residual toner remaining on the latent image holding member 1Y is removed and recovered by the cleaning device 6Y.

Furthermore, primary transfer biases applied to the primary transfer roller 5M, 5C, and 5K in the second unit 10 M and the units located further downstream are controlled in a manner similar to the control of the first unit.

The intermediate transfer belt 20 having the yellow toner image transferred in the first unit 10Y is transported sequentially through the second to fourth units of 10M, 10C, and 10K, and thus, toner images of the respective colors are transferred and superposed to achieve multiple transfers.

The intermediate transfer belt 20 on which toner images of four colors are multi layer transferred by the first to fourth units reaches a secondary transfer portion that is formed by the intermediate transfer belt 20, a support roller 24 in contact with the inner surface of the intermediate transfer belt 20, and a secondary transfer roller 26 (secondary transfer unit) disposed at the latent image holding surface side of the intermediate transfer belt 20. On the other hand, a recording sheet (recording medium) P is fed at a predetermined timing through a feeding mechanism, to between the secondary transfer roller 26 and the intermediate transfer belt 20 which are in pressure contact, and a predetermined secondary transfer bias is applied to the support roller 24. The applied transfer bias has the (−) polarity, which is the same as the polarity (−) of the toner. An electrostatic force directing from the intermediate transfer belt 20 to the recording sheet P is exerted on the toner image, thereby transferring the toner image on the intermediate transfer belt 20 to the recording sheet P. The applied secondary transfer bias is determined depending on the electric resistance detected by a resistance detection unit (not shown) that detects the resistance of the secondary transfer portion, and the voltage of the secondary transfer bias is controlled accordingly.

Hereinafter, the recording sheet P is delivered to a fixing device (fixing unit) 28, at which the toner image is heated, and the toner image composed of superposed color toner images is melted and fixed onto the recording sheet P. The recording sheet P after completion of the color image fixation is transported to a discharge section, and a series of color image forming operations is completed.

In addition, the image forming apparatus described above as an example has a configuration in which a toner image is transferred to the recording sheet P through the intermediate transfer belt 20. However, the image forming apparatus is not limited to this configuration, and may have a configuration in which a toner image is directly transferred from the latent image holding member to the recording sheet.

<Developer Cartridge>

The developer cartridge may be a developer cartridge configured to supply a developer to a developing unit in which the developer of the present exemplary embodiment is accommodated and simultaneously, an electrostatic latent image formed on the latent image holding member is developed to form a toner image, and be attachable to or detachable from the image forming apparatus. In the case where the developer accommodated in the developer cartridge is reduced, the developer cartridge is exchanged.

<Process Cartridge>

Figure 4:
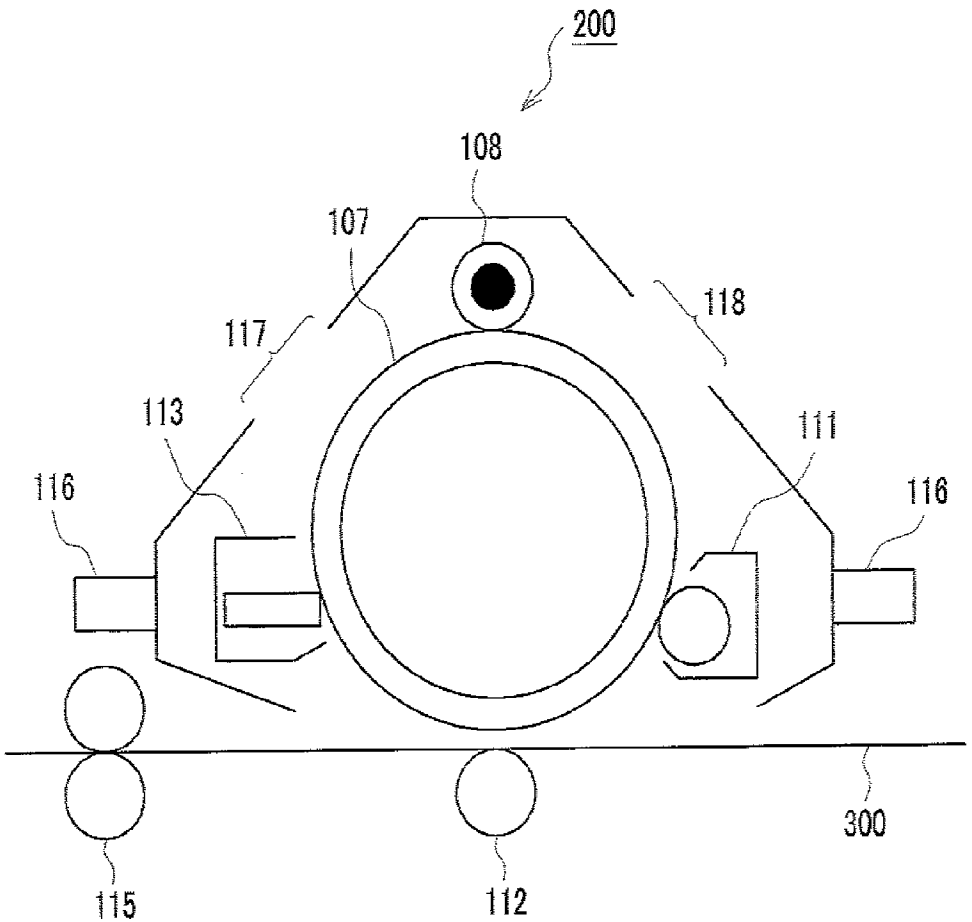
FIG. 4 is a schematic configuration diagram showing an example of a process cartridge of the present exemplary embodiment.

FIG. 4 is a schematic configuration diagram showing an exemplary embodiment of one preferable example of the process cartridge that accommodates the developer for electrostatic photography according to the present exemplary embodiment. A process cartridge 200 is one obtained by assembling a developing device 111, a photoreceptor 107, a charging roller 108, a photoreceptor cleaning device 113, an opening for light exposure 118, and an opening for erasing exposure 117 with the use of a fixing rail 116, and integrating them. In addition, reference number 300 in FIG. 4 represents a recording sheet (recording medium).

Furthermore, this process cartridge 200 is detachable from the main body of the image forming apparatus including a transfer device 112, a fixing device 115, and the other components not shown in the figure, and constitutes the image forming apparatus with the main body of the image forming apparatus.

The process cartridge 200 shown in FIG. 4 is equipped with the photoreceptor 107, the charging device 108, the developing device 111, the cleaning device 113, the opening for light exposure 118, and the opening for erasing exposure 117, but these devices may be selectively combined. The process cartridge of the present exemplary embodiment may be equipped with at least one selected from the photoreceptor 107, the charging device 108, the cleaning device (cleaning unit) 113, the opening for light exposure 118, and the opening for erasing exposure 117, in addition to the developing device 111.

EXAMPLES

Hereinafter, the exemplary embodiment will be more specifically described in detail with reference to Examples and Comparative Examples. However, the exemplary embodiment is not limited to the following Examples. Further, the "part (s)" and "%" are based on mass unless otherwise specified.

(Preparation of Toner Particles (1))

—Preparation of Resin Fine Particle Dispersion (1)—

Styrene: 400 parts
n-Butyl acrylate: 55 parts
Acrylic acid: 12 parts
Ion-exchanged water: 650 parts
Anionic surfactant (manufactured by Dow Chemical Company, "DOWFAX"): 2.00 parts The above composition is stirred and mixed under nitrogen atmosphere, and 50 parts of ion-exchanged water in which 3.3 parts of ammonium persulfate is put thereinto, and the mixture is subjected to emulsification polymerization at 75° C. for 10 hours to prepare a resin fine particle dispersion (1) in which resin particles having a weight average molecular weight Mw=25200 are dispersed.

—Preparation of Resin Fine Particle Dispersion (2)—

Styrene: 300 parts
n-Butyl acrylate: 100 parts
Acrylic acid: 15 parts
1,10-Decanediol: 5 parts
Anionic surfactant (manufactured by Dow Chemical Company, "DOWFAX"): 5 parts The above composition is stirred and mixed under nitrogen atmosphere, and 50 parts of ion-exchanged water in which 6.5 parts of ammonium persulfate is put thereinto, and the mixture is subjected to emulsification polymerization at 65° C. for 8 hours to prepare a resin fine particle dispersion (2) in which resin particles having a weight average molecular weight Mw=29800 are dispersed.

—Preparation of Colorant Dispersion—

Carbon black (Mogal L manufactured by Cabot Corporation): 55 parts
Nonionic surfactant (Nonipole 400: Sanyo Chemical Industries, Ltd.): 7 parts
Ion-exchanged water: 250 parts The above components are mixed and stirred for 10 minutes using a homogenizer (ULTRA-TURRAX T50: manufactured by IKA Laboratories, Ltd.), and then subjected to a dispersion treatment with an Altimizer to prepare a colorant dispersant in which colorant (carbon black) particles having an average particle diameter of 235 nm are dispersed.

—Preparation of Release Agent Dispersion—

Paraffin wax (HNP0190: manufactured by NIPPON SEIRO, melting point of 85° C.): 120 parts
Cationic surfactant (Sanisol B50: manufactured by Kao Corporation): 7 parts
Ion-exchanged water: 300 parts The above components are dispersed for 10 minutes in a round flask made of stainless steel using a homogenizer (ULTRA-TURRAX T50: manufactured by IKA Laboratories, Ltd.), and then subjected to a dispersion treatment with a pressure-discharging homogenizer to prepare a release agent dispersion in which wax particles having an average particle diameter of 590 nm are dispersed.

(Production of Toner Particles 1)

The resin fine particle dispersion (1) and the resin fine particle dispersion (2) are mixed at a ratio of 3:2, and 300 parts of the mixed resin particle dispersion, 65 parts of the colorant dispersion, 90 parts of the release agent dispersion, 0.4 part of polyaluminum hydroxide (Paho2S manufactured by Asada Chemical), and 55 parts of ion-exchanged water are mixed in a round flask made of stainless steel using a homogenizer (ULTRA-TURRAX T50: manufactured by IKA Laboratories, Ltd.), and dispersed, and then heated to 50° C. while stirring the inside of the flask in an oil bath for heating. After holding the mixture at 50° C. for 30 minutes, it is confirmed that aggregated particles having D50v of 3.8 μm are produced. Further, the temperature of the oil bath for heating is raised to 56° C. and then held for 1 hour, thereby providing a D50v of 5.5 p.m. Thereafter, to a dispersion including the aggregated particles is added 120 parts of the resin fine particle dispersion (1), and then the temperature of the oil bath for heating is raised to 50° C. and held for 30 minutes. To a dispersion including the aggregated particles is added 1 N sodium hydroxide to adjust the pH of the system to 7.0. Then, the flask made of stainless steel is sealed, continuously stirred using a magnetic seal, heated to 78° C., and held for 5 hours. After cooling, the toner particles are separated by filtration, washed with ion-exchanged water four times, and then lyophilized to obtain toner particles 1. The volume average particle diameter and the shape factor SF1 of the obtained toner particles 1 are 6.3 μm and 127, respectively.

(Production of Toner Particles 2)

In the same manner as in the method for producing the toner particle (1), except that the temperature in the step in which "the pH is adjusted to 7.0, and then the flask made of stainless steel is sealed, continuously stirred using a magnetic seal, heated to 78° C., and held for 5 hours" is changed to 82° C. and the holding time is changed to 8.5 hours to obtain toner particles 2.

(Production of Large-Diameter External Additives 1)

To 100 parts of silica fine particles formed by a sol-gel method, having a number average particle diameter of 180 nm, is sprayed 5 parts of a dimethylsilicon oil having a viscosity of 100 cSt by a spray drying method, and the mixture is sprayed to the particles suspended in the gas phase, subjected to a surface treatment, and crushed with a jet mill to give large-diameter external additives 1.

(Production of Large-Diameter External Additives 2)

An anatase-type titanic fine particle having a number average particle diameter of 105 nm is subjected to a surface treatment with hexamethyldisilazane to give large-diameter external additives 2.

(Production of Large-Diameter External Additives 3)

Emulsification polymerization is performed using a monomer obtained by adding 15 parts of acrylic acid to 90 parts of styrene to obtain polystyrene-acrylic acid copolymer particles having an average particle diameter of 750 nm. These particles are washed with ion-exchanged water, lyophilized, andmade into powders to give large-diameter external additives 3.

(Production of Large-Diameter External Additives 4)

In the same manner as in the method for producing the large-diameter external additives 1 except that silica fine particles formed by a sol-gel method, having a number average particle diameter of 75 nm, are used, large-diameter external additives 4 are obtained.

(Production of Large-Diameter External Additive 5)

A mixture formed by dissolving 5 parts of benzoyl peroxide to a monomer obtained by mixing 15 parts of acrylic acid with 90 parts of styrene is dispersed in water using a homomixer, and subjected to suspension polymerization to obtain polystyrene-acrylic acid copolymer particles having a number average particle diameter of 900 nm. These particles are washed with ion-exchanged water, lyophilized, and made into powders to give large-diameter external additives 5.

(Production of Rugged Particles 1)

(Synthesis of Crystalline Polyester Resin (1))

To a heat-dried three-necked flask are put 100 parts of ethylene glycol, 15 parts of sodium dimethyl 5-sulfoisophthalate, 220 parts of dimethyl sebacate, and 0.5 part of dibutyl tin oxide as a catalyst, and then the air in the container is changed to an inert atmosphere by an operation under reduced pressure with nitrogen gas, followed by stirring for 5 hours at 180° C. by mechanical stirring. Thereafter, the temperature is slowly raised to 240° C. under reduced pressure, followed by stirring for 1 hour, air-cooling at a viscous state, and stopping the reaction, to synthesize a crystalline polyester resin (1). The melting point of the crystalline polyester resin (1) is 65° C.

200 parts of the crystalline polyester resin (1), 180 parts of ethyl acetate, and 0.1 part of an aqueous sodium hydroxide solution (0.4 N) are prepared, put into a 500-ml separable flask, heated to 75° C., and stirred with a three-one motor (manufactured by Shinto Scientific Co., Ltd.) to prepare a crystalline resin mixture liquid (1). While this crystalline resin mixture liquid (1) is stirred, 400 parts of an aqueous sodium hydroxide solution (0.05 N) is slowly added thereto to perform phase inversion emulsification and solvent removal, thereby obtaining a crystalline polyester resin dispersion (1).

100 parts of the crystalline polyester resin dispersion (1) is added 1.5 part of polyaluminum sulfate, followed by heating to 45° C. and stirring for 4 hours. Thereafter, the supernatant is removed by centrifugation from the slurry, and the precipitate is lyophilized at −45° C. to obtain rugged particles 1. The rate of ruggedness and the long-axis diameter (average long-axis diameter) of the rugged particles 1 are 43% and 11.5 μm, respectively.

(Production of Rugged Particles 2)

A monomer obtained by mixing 80 parts of styrene and 20 parts of acrylic acid is subjected to suspension polymerization to obtain polystyrene-acrylic acid copolymer particles having an average particle diameter of 2.3 μm. These particles are washed with ion-exchanged water, and then diluted with ion-exchanged water to a solid content concentration of 20% to obtain a slurry. To 100 parts of this slurry are added 10 parts of a release agent dispersion and 1.2 parts of polyaluminum sulfate, followed by stirring for 10 minutes with a magnetic stirrer while keeping the temperature of the liquid at 25° C., spray-drying for granulation, and mesh-sieving to remove the crude components, to obtain rugged particles 2. The rate of ruggedness and the long-axis diameter of the rugged particle 2 are 33% and 9.5 μm, respectively.

(Production of Rugged Particles 3)

In the same manner as in the method for producing the rugged particles 1, except that 2 parts of ferric chloride is used instead of polyaluminum sulfate used in the production of the rugged particles 1 and the mixture is stirred for 60 minutes while keeping the temperature of the liquid after the addition of ferric chloride at 25° C., rugged particles 3 are obtained. The rate of ruggedness and the long-axis diameter of the rugged particles 3 are 66% and 12.0 μm, respectively.

(Production of Rugged Particles 4)

40 parts of the crystalline polyester resin (1) and 60 parts of polyvinyl alcohol having a molecular weight Mw of 7200 and a saponification degree of 70 mol % are kneaded with a heating biaxial kneader, and then cooled, pulverized, and finely pulverized to obtain mixture fine particles of a polyester resin and a polyvinyl alcohol resin. 10 parts of the mixture fine particles are dispersed in 1000 parts of ion-exchanged water and stirred while keeping the temperature at 50° C. for 24 hours. A liquid for filtering the dispersion is removed, and the solid content is washed with ion-exchanged water and then lyophilized to obtain rugged particles 4. The rate of ruggedness and the long-axis diameter of the rugged particles 4 are 50% and 75.0 μm, respectively.

(Production of Rugged Particles 5)

In the same manner as in the method for producing the rugged particles 1, except that the amount of polyaluminum sulfate used in the production of the rugged particles 1 is changed to 0.5 part and the stirring time after the addition of polyaluminum sulfate is changed to 1 hour, rugged particles 5 are obtained. The rate of ruggedness and the long-axis diameter of the rugged particles 5 are 48% and 6.0 μm, respectively.

(Production of Rugged Particles 6)

In the same manner as in the method for producing the rugged particles 2, except that a release agent dispersion is not added, rugged particles 6 are obtained. The rate of ruggedness and the long-axis diameter of the rugged particles 6 are 44% and 12.0 μm, respectively.

(Production of Rugged Particles 7)

A monomer obtained by mixing 80 parts of styrene and 20 parts of acrylic acid is subjected to emulsification polymerization to obtain polystyrene-acrylic acid copolymer particles having an average particle diameter of 0.32 μm. These particles are washed with ion-exchanged water, and then diluted with ion-exchanged water to a solid content concentration of 35% to obtain a slurry. 100 parts of this slurry are stirred for 60 minutes with a magnetic stirrer while keeping the temperature of the liquid at 80° C., and 20 parts of the crystalline polyester resin dispersion (1) is added thereto, followed by further stirring at 60° C. for 60 minutes. The dispersion mixture is spray-dried for granulation, and mesh-sieving to remove the crude components, to obtain rugged particles 7. The rate of ruggedness and the long-axis diameter of the rugged particle 7 are 25% and 8.8 μm, respectively.

(Production of Rugged Particles 8)

In the same manner as in the method for producing the rugged particles 4, except that 70 parts of the crystalline polyester resin (1) and 60 parts of polyvinyl alcohol having a molecular weight Mw of 35000 and a saponification degree of 98 mol % are used, rugged particles 8 are obtained. The rate of ruggedness and the long-axis diameter of the rugged particles 8 are 75% and 20.3 μm, respectively.

(Production of Carrier)

2.5 parts of a styrene-acrylic resin (styrene: methyl methacrylate=10:90, Mw: 350,000) is put into 45 parts of toluene to produce a resin solution. To this resin solution is put 0.7 part of carbon black, and the mixed liquid is finely dispersed for 30 minutes using a sand mill to prepare a dispersion. 25 parts of the dispersion is mixed with 100 parts of ferrite particle having a volume average particle diameter of 30 μm. Further, the mixture is placed in a vacuum degassing-type kneader and stirred for 30 minutes while heating at 80° C., and the solvent is removed under stirring under reduced pressure. After removal of the solvent, the mixture is sieved with a 75-μm mesh to remove the aggregates, thereby obtaining a carrier.

Examples 1 to 13 and Comparative Examples 1 to 5

100 parts of the toner particles (types according to Table 1), 2 parts of the large external additives (types according to Table 1), and 1 part of the hexamethyldisilazane-treated silica having a number average particle diameter of 8 nm are blended using a Henschel mixer at a peripheral speed of 20 m/s for 15 minutes, and then the crude particles are removed using a 45 μm-mesh sieve to obtain a toner. To 100 parts of the toner are added rugged particles (types and amounts according to Table 1) and 5 parts of a carrier, followed by stirring and mixing. The mixture is accommodated in a cartridge to prepare each cartridge for distribution for a test.

Further, 10 parts of the obtained toner, 85 parts of a carrier, and the rugged particles (types and amounts according to Table 1) are stirred for 20 minutes at 20 rpm using a V-blender, and sieved using a 212-μm mesh to obtain each of the developers.

[Evaluation]

A DocuCentre-III C3300-modified machine manufactured by Fuji Xerox Co., Ltd., which is modified to output a desired image at an arbitrary number of sheets and an arbitrary process speed is prepared. A3 of color application paper "J" manufactured by Fuji Xerox Co., Ltd. is put into a paper container, and each developer is filled in the developing unit as described above. The modified machine is put into a controlled environment room with a temperature of 27° C. and a humidity of 65%, and evaluation is performed.

Figure 5A:
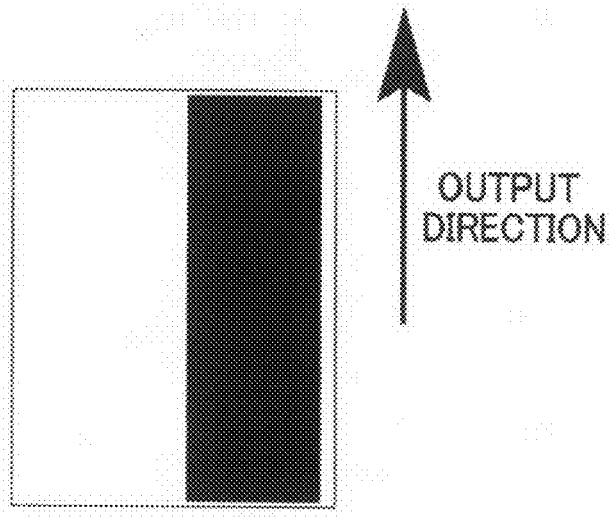
FIGS. 5A to 5C are views for explaining the evaluation methods of Examples.
Figure 5B:
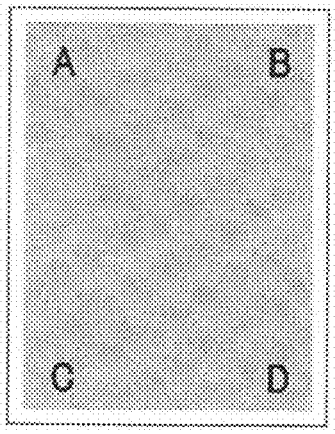

First, 500 sheets of a continuous band image having a portion with an image density of 100% in the right output direction of the paper shown in FIG. 5A are output. Thereafter, one sheet of a whole-surface halt-tone image (image density of 30%) shown in FIG. 5B is output, and the densities of the portion corresponding to the portion with an image density of 100% (B and D in the figure) and the other portions (A and C in the figure) are measured by means of X-Rite, and thus, the density unevenness is measured. In addition, one sheet of the line image having 0.75 point shown in FIG. 5C is output, and the fade and turbulence of the line image are confirmed.

Figure 5C:
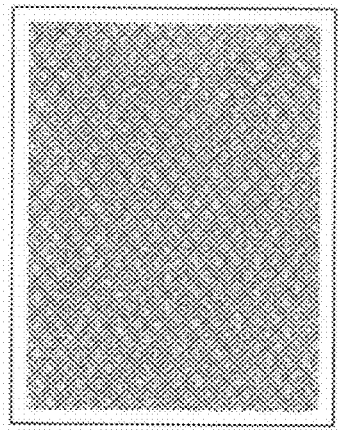

Moreover, 9500 sheets of the image shown in FIG. 5A are output, and then one sheet of each of the whole-surface halftone image shown in FIG. 5B and the line image shown in FIG. 5C is output, and evaluation is performed in the same manner as described above. The criteria for evaluation of the density unevenness and the line image are as follows. Further, the other image quality defects and the contamination in the machine are observed.

The obtained results are shown in Table 2.

—Density Unevenness—

A: A highly excellent level with homogeneity, at which there is no occurrence of unevenness in the image density.

B: A level at which unevenness in the image density occurs, but is substantially not recognizable with the naked eye.

C: A level at which unevenness in the image density is slightly confirmed, but there is no problem in practical use.

D: A level at which unevenness in the image density is noticeable, thus providing a poor image not suitable for practical use.

—Line Image—

A: A highly excellent level, at which there is no occurrence of fades or gaps in the line image.

B: A level at which fades or gaps are confirmed in extremely small parts of the line image when observed with a 20× magnification loupe.

C: A level at which occurrence of fades or gaps is slightly confirmed with the naked eye in the line image and which has no problem in practical use.

D: A level at which occurrence of fades or gaps is noticeable in the line image, thus providing a poor image not suitable for practical use.

TABLE 1

| | Rugged particles | | | | | Large-diameter external additives | | Toner particles | | |
|---|---|---|---|---|---|---|---|---|---|---|
| | Number | Rate of ruggedness | Amount of rugged particles % by number | Long-axis diameter/toner diameter of rugged particles | Long-axis diameter | Number | Particle diameter | Number | Shape factor | Particle diameter |
| Example 1 | (1) | 43 | 0.50 | 1.83 | 11.5 | (1) | 180 | (1) | 127 | 6.3 |
| Example 2 | (1) | 43 | 1.00 | 1.83 | 11.5 | (2) | 105 | (1) | 127 | 6.3 |
| Example 3 | (1) | 43 | 1.00 | 1.83 | 11.5 | (3) | 750 | (1) | 127 | 6.3 |
| Example 4 | (2) | 33 | 1.00 | 1.51 | 9.5 | (1) | 180 | (1) | 127 | 6.3 |
| Example 5 | (3) | 66 | 1.00 | 1.90 | 12.0 | (1) | 180 | (1) | 127 | 6.3 |
| Example 6 | (1) | 43 | 0.07 | 1.83 | 11.5 | (1) | 180 | (1) | 127 | 6.3 |
| Example 7 | (1) | 43 | 0.04 | 1.83 | 11.5 | (1) | 180 | (1) | 127 | 6.3 |
| Example 8 | (1) | 43 | 9.50 | 1.83 | 11.5 | (1) | 180 | (1) | 127 | 6.3 |
| Example 9 | (1) | 43 | 13.50 | 1.83 | 11.5 | (1) | 180 | (1) | 127 | 6.3 |
| Example 10 | (4) | 50 | 1.00 | 11.90 | 75.0 | (1) | 180 | (1) | 127 | 6.3 |
| Example 11 | (5) | 48 | 1.00 | 0.95 | 6.0 | (1) | 180 | (1) | 127 | 6.3 |
| Example 12 | (6) | 44 | 1.00 | 1.90 | 12.0 | (1) | 180 | (1) | 127 | 6.3 |
| Example 13 | (1) | 43 | 1.00 | 1.89 | 11.5 | (1) | 180 | (2) | 113 | 6.1 |
| Comparative Example 1 | None | — | — | — | — | (1) | 180 | (1) | 127 | 6.3 |
| Comparative Example 2 | (7) | 25 | 1.00 | 1.40 | 8.8 | (1) | 180 | (1) | 127 | 6.3 |
| Comparative Example 3 | (8) | 75 | 1.00 | 3.22 | 20.3 | (1) | 180 | (1) | 127 | 6.3 |
| Comparative Example 4 | (1) | 43 | 1.00 | 1.83 | 11.5 | (4) | 75 | (1) | 127 | 6.3 |
| Comparative Example 5 | (1) | 43 | 1.00 | 1.83 | 11.5 | (5) | 900 | (1) | 127 | 6.3 |

TABLE 2

| | Evaluation | | | | |
|---|---|---|---|---|---|
| | Density unevenness after 500 sheets | Line image after 500 sheets | Density unevenness after 10000 sheets | Line image after 10000 sheets | Observation of other image quality defects or contamination in the machine |
| Example 1 | A | A | A | A | |
| Example 2 | A | A | A | B | |
| Example 3 | A | A | A | B | Contamination in the machine |
| Example 4 | A | A | A | B | |
| Example 5 | A | A | A | B | |
| Example 6 | A | A | B | A | |
| Example 7 | B | A | B | A | |
| Example 8 | A | A | A | A | Slight contamination in the machine |
| Example 9 | A | A | A | A | Contamination in the machine |
| Example 10 | B | A | B | C | |
| Example 11 | A | A | B | B | Contamination in the machine |
| Example 12 | A | A | B | A | |
| Example 13 | A | A | A | A | Slight streak contamination in image |
| Comparative Example 1 | C | A | D | A | |
| Comparative Example 2 | D | A | D | A | |
| Comparative Example 3 | B | A | D | A | Contamination in the machine |
| Comparative Example 4 | A | B | A | D | |
| Comparative Example 5 | A | C | A | D | Contamination in the machine |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer for electrostatic photography, comprising:

a toner containing toner particles containing a colorant and a binder resin, and an external additive having a number average particle diameter of about 100 nm or more and about 800 nm or less; and rugged particles having a rate of ruggedness represented by formula (1) of about 30% or more and about 70% or less:

$$\text{Rate of Ruggedness}=100-(\text{Projected area}/\text{Envelope area})\times 100 \quad (1).$$

2. The developer for electrostatic photography according to claim 1, wherein the amount of the rugged particles is about 0.05% by number or more and about 10% by number or less, relative to the toner particles.

3. The developer for electrostatic photography according to claim 1, wherein the average long-axis diameter of the rugged particles is about 1.2 times or more and about 10 times or less the volume average particle diameter of the toner particles.

4. The developer for electrostatic photography according to claim 1, wherein the average shape factor of the toner particles is in the range of about 100 or more and about 140 or less.

5. The developer for electrostatic photography according to claim 1, wherein the number average particle diameter of the external additive is in the range of about 140 nm or more and about 500 nm or less.

6. The developer for electrostatic photography according to claim 1, wherein the amount of the external additive is in the range of about 0.5 part by mass or more and about 5 parts by mass or less, relative to 100 parts by mass of the toner particles.

7. The developer for electrostatic photography according to claim 1, wherein the rate of ruggedness of the rugged particles is in the range of about 35% or more and about 65% or less.

8. The developer for electrostatic photography according to claim 1, wherein the amount of the rugged particles to the toner particles is in the range of about 0.1% by number or more and about 9% by number or less.

9. A process cartridge for image forming apparatus comprising a developer holding member and an accommodate chamber containing the developer for electrostatic photography according to claim 1.

10. The process cartridge for image forming apparatus according to claim 9, wherein the amount of the rugged particles in the developer for electrostatic photography is about 0.05% by number or more and about 10% by number or less, relative to the toner particles.

11. The process cartridge for image forming apparatus according to claim 9, wherein the average long-axis diameter of the rugged particles in the developer for electrostatic photography is about 1.2 times or more and about 10 times or less the volume average particle diameter of the toner particles.

12. An image forming apparatus comprising:

a latent image holding member;

a charging unit that charges the surface of the latent image holding member;

an electrostatic latent image forming unit that forms an electrostatic latent image on the surface of the latent image holding member;

a developing unit that develops the electrostatic latent image by the developer for electrostatic photography according to claim 1 to form a toner image;

a transfer unit that transfers the toner image to a recording medium; and a fixing unit that fixes the toner image on the recording medium.

13. The image forming apparatus according to claim 12, wherein the amount of the rugged particles in the developer for electrostatic photography is about 0.05% by number or more and about 10% by number or less, relative to the toner particles.

14. The image forming apparatus according to claim 12, wherein the average long-axis diameter of the rugged particles in the developer for electrostatic photography is about 1.2 times or more and about 10 times or less the volume average particle diameter of the toner particles.

15. An image forming method comprising:

charging the surface of a latent image holding member surface;

forming an electrostatic latent image on the latent image holding member surface;

developing the electrostatic latent image by the developer for electrostatic photography according to claim 1 to form a toner image;

transferring the toner image to a recording medium; and fixing the toner image on the recording medium.

16. The image forming method according to claim 15, wherein the amount of the rugged particles in the developer for electrostatic photography is about 0.05% by number or more and about 10% by number or less, relative to the toner particles.

17. The image forming method according to claim 15, wherein the average long-axis diameter of the rugged particles in the developer for electrostatic photography is about 1.2 times or more and about 10 times or less the volume average particle diameter of the toner particles.

* * * * *